United States Patent [19]

Heitmann et al.

[11] 4,333,335

[45] Jun. 8, 1982

[54] APPARATUS FOR TESTING THE WRAPPERS OF CIGARETTES OR THE LIKE

[75] Inventors: Uwe Heitmann, Hamburg; Willy Rudszinat, Dassendorf, both of Fed. Rep. of Germany

[73] Assignee: Hauni-Werke Körber & Co. KG, Hamburg, Fed. Rep. of Germany

[21] Appl. No.: 33,387

[22] Filed: Apr. 26, 1979

Related U.S. Application Data

[63] Continuation of Ser. No. 384,279, Jul. 31, 1973, abandoned.

[30] Foreign Application Priority Data

Aug. 2, 1972 [DE] Fed. Rep. of Germany ..... 2237971

[51] Int. Cl.[3] ..... G01N 15/08

[52] U.S. Cl. ..... 73/41; 73/38

[58] Field of Search ..... 73/38, 41, 45, 45.1, 73/45.2

[56] References Cited

U.S. PATENT DOCUMENTS 3,408,858 11/1968 Kaeding et al. ..... 73/45.2

3,564,902 2/1971 Heitmann ..... 73/45.1 X 3,677,068 7/1972 Schmermund ..... 73/41

3,720,310 3/1973 Lehmann ..... 73/45.2 X

*Primary Examiner*—Kyle L. Howell

*Assistant Examiner*—Joseph W. Roskos

*Attorney, Agent, or Firm*—Kontler & Grimes

[57] ABSTRACT

A testing apparatus for filter cigarettes or analogous rod-shaped articles has a drum-shaped conveyor with a smooth or fluted cylindrical surface and with radially inwardly extending suction slots which are connected to the intake of a fan. Each slot is disposed between two cradles which support the articles to be tested in such a way that the wrappers of the articles remain spaced apart from the periphery of the conveyor. The cradles engage the articles close to the respective ends of the articles and have small article-engaging surfaces to thus insure the detection of all or nearly all leaks during testing with a fluid medium which is introduced into the interior of a wrapper during travel past the testing station. The streams of air which flow into the slots of the conveyor hold the articles against ejection under the action of gravity and/or centrifugal force.

11 Claims, 5 Drawing Figures

Fig.3
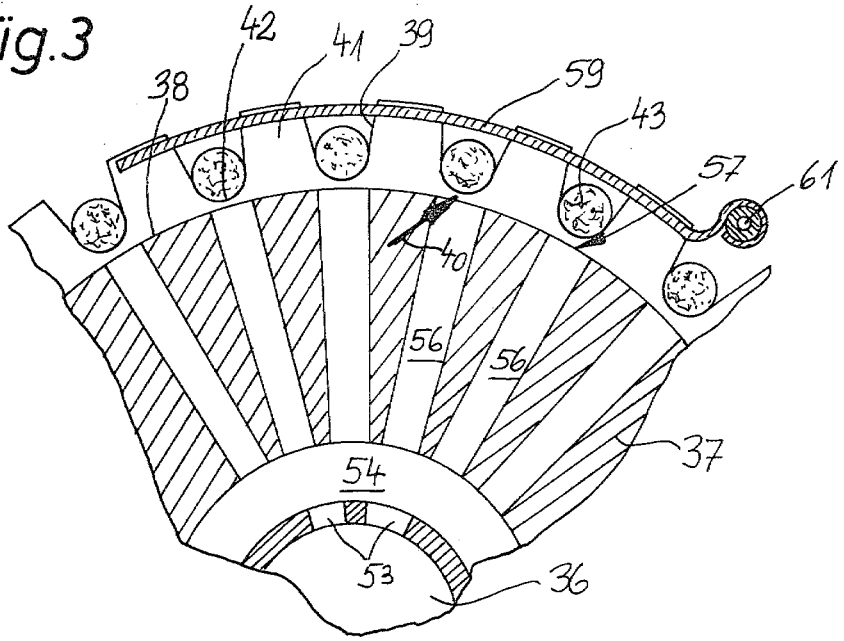
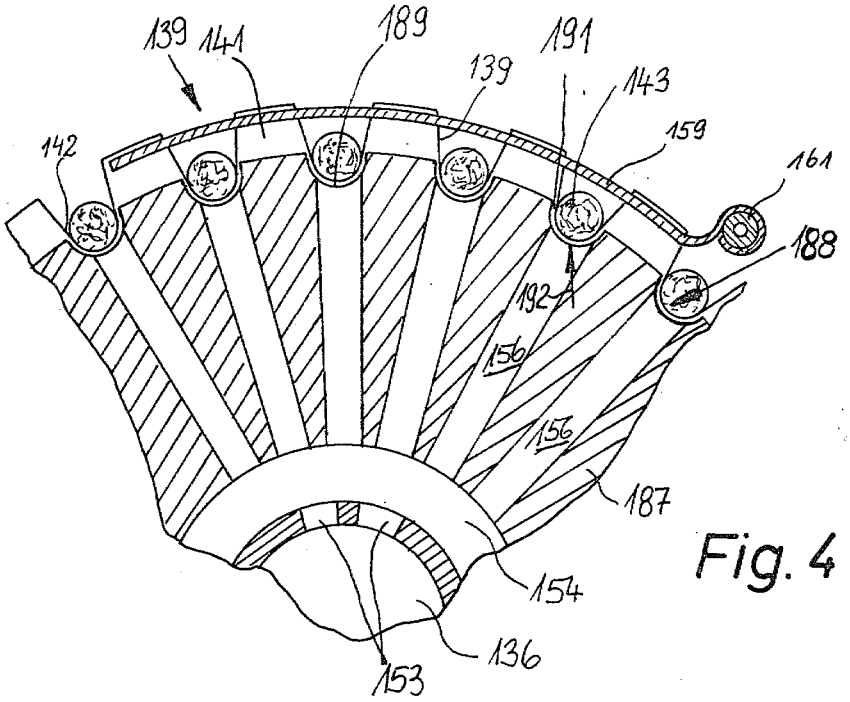
Fig. 4

APPARATUS FOR TESTING THE WRAPPERS OF CIGARETTES OR THE LIKE

This is a continuation of application Ser. No. 384,279, filed July 31, 1973, now abandoned.

BACKGROUND OF THE INVENTION

The present invention relates to apparatus for testing plain or filter cigarettes or analogous articles (including plain or filter cigarillos, cigars, filter rod sections in the form of hollow tubes or wrapped fillers of fibrous or other filter material for tobacco smoke) which consist of and have open-ended tubular wrappers. More particularly, the invention relates to apparatus for testing the condition of tubular wrappers which form part of cigarettes or the like for the presence of absence of leaks in the form of open seams, tears, holes and/or similar defects. Still more particularly, the invention relates to apparatus for testing cigarettes or the like wherein the articles to be tested travel sideways during transport past a testing station where the wrappers of the articles are tested by means of a fluid medium.

It is already known to test cigarettes or like rod-shaped articles in an apparatus wherein the articles to be tested are transported sideways by a drum or another suitable endless conveyor which is provided with means for sealing the interior of the wrapper from its exterior during travel past the testing station. As a rule, the conveyor is provided with openings which are connected to a suction generating device so that the wrappers of articles to be tested are attracted to the conveyor by suction. A testing fluid is introduced into one or both ends of a wrapper which moves past the testing station, and the pressure of testing fluid is monitored by a suitable transducer which furnishes signals to an ejector whenever the pressure of testing fluid deviates from a range of pressures which are indicative of satisfactory wrappers. Thus, if a wrapper exhibits an open seam or a hole, the testing fluid escapes into the atmosphere and the pressure in the wrapper is below the minimum pressure which is still indicative of satisfactory wrappers.

All recent types of cigarette making machines embody one or more testing apparatus which are designed to determine the defects of cigarettes and to initiate the segregation of defective cigarettes from satisfactory cigarettes. The defects may include the aforementioned leaks in the wrappers, the absence of a filter plug or wrapped tobacco rod section in a filter cigarette, excessively compacted or loose tobacco fillers, improperly convoluted uniting bands which serve to connect the filter plug to the tobacco rod section of a filter cigarette, or soft tobacco-containing cigarette ends. Leaks in the wrappers are particularly irritating to the smoker because the taste of smoke changes considerably if a leaky wrapper allows atmospheric air to mix with tobacco smoke during flow of smoke into the mouth.

U.S. Pat. Nos. 3,408,858 and 3,533,279 disclose testing apparatus wherein the articles to be tested are transported by rotary drums which carry flutes wherein the articles rest during travel past the testing station. Each flute normally consists of three or more aligned cradles each of which is in contact with a large portion of the respective wrapper whereby the wrapper portions which contact the cradles cannot be tested for the presence or absence of leaks because the cradles seal or substantially seal the leaks in the wrapper portions which are in contact therewith. The drum carries coupling elements which engage the ends of wrappers during testing so that the air surrounding the exterior of a wrapper travelling past the testing station cannot flow into the interior of such wrapper or vice versa. The coupling elements further serve to admit into the wrappers a testing fluid which escapes through the holes, open seams or other leaks of the wrappers so that the pressure of testing fluid in a defective wrapper is less than a predetermined minimum pressure which is still indicative of a satisfactory wrapper. The pressure of testing fluid is monitored by one or more transducers which cause one or more ejectors to segregate the cigarettes with defective wrappers from satisfactory cigarettes.

A drawback of the just described testing apparatus is that if a cradle overlaps a hole in the wrapper of a cigarette which travels past the testing station, the testing fluid cannot escape by way of such leak so that the leak remains undetected. As mentioned before, the cradles of the drum-shaped testing conveyor are provided with relatively large article-contacting surfaces so that the likelihood of sealing of a leak during testing is quite pronounced.

Another drawback of presently known testing apparatus is that their conveyors are unable to properly retain the articles in optimum positions for testing when the articles must be tested at a rate at which they are being made in a high-speed producer, such as a cigarette rod making machine or a filter cigarette making machine which turns out up to and in excess of 70 articles per second. As a rule, the cigarettes are held by suction; however, when the centrifugal force is very strong due to high rotational speed of the conveyor of the testing apparatus, the cigarettes must be held by additional means, such as by the coupling elements which admit to their wrappers a testing fluid, whereby the additional retaining means are likely to deform and/or otherwise deface or damage the wrappers. If the articles are held by suction alone, the suction must be increased to an extent which can be achieved only by resorting to bulky, complex, expensive and extremely noisy compressors, pumps, fans or other suction generating devices.

SUMMARY OF THE INVENTION

An object of the invention is to provide a novel and improved testing apparatus for plain or filter cigarettes or analogous elongated smokers' products which embody or consist of open-ended tubular wrappers, and to construct and assemble the testing apparatus in such a way that it is more likely to detect each and every leak in a wrapper than heretofore known testing apparatus.

Another object of the invention is to provide a testing apparatus which can properly retain the articles to be tested even if such articles are supplied at a very high rate of speed whereby the retention of rapidly moving articles against the influence of gravity and/or centrifugal force does not necessitate mechanical clamping action which would be likely to damage or deface the wrappers.

A further object of the invention is to provide a testing apparatus wherein the articles are held by suction and the retention of articles by suction does not result in the generation of excessive noise or in excessive energy consumption even if the articles are transported at a speed at which they issue from a modern mass-producing machine.

An additional object of the invention is to provide a testing apparatus wherein the retaining action can be regulated at will to thus insure that the heavier portions of articles whose inertia is greater than that of lighter portions can be retained and held by a force exceeding the retaining force acting upon the lighter portions.

Still another object of the invention is to provide novel and improved article supporting means for use on the conveyor of a testing apparatus for cigarettes or the like.

A further object of the invention is to provide a novel conveyor for use in the improved testing apparatus.

The invention is embodied in an apparatus for testing cigarettes or analogous elongated articles consisting of or having open-ended tubular wrappers made of cigarette paper, reconstituted tobacco, cork or the like. The testing apparatus comprises conveyor means which is arranged to transport successive articles to be tested sideways past a testing station and includes pairs of spaced apart article supporting elements (e.g., in the form of cradles) whereby each pair of supporting elements engages spaced apart portions of the wrapper of an article during travel past the testing station, at least one opening (e.g., a slot) provided in the conveyor means intermediate each pair of supporting elements and being spaced apart from the wrapper of the article in the respective pair of supporting elements so that the wrappers need not contact the conveyor means at all but contact only small portions of surfaces on the supporting elements, and suction generating means communicating with the openings, at least while the openings travel past the testing station, so that the streams of air flowing into the openings attract the wrappers of articles to the respective pairs of supporting elements and prevent the articles from leaving the respective supporting elements due to inertia, gravity and/or centrifugal force.

The conveyor means preferably includes an endless conveyor (e.g., a rotary drum or one or more endless flexible elements), and the width of each supporting element, as considered in the axial direction of the articles to be tested, is only a small fraction of the distance between a pair of aligned supporting elements. The area of the article-engaging surface on each supporting element is preferably smaller than (e.g., a very small fraction of) the area of the end face of an article. This insures that the overall area of contact between the wrapper of an article and the corresponding supporting elements is a minute fraction of the overall area of the exposed surface of a wrapper so that the supporting elements are highly unlikely to seal a hole or another leaky part of a wrapper during travel past the testing station.

The novel features which are considered as characteristic of the invention are set forth in particular in the appended claims. The improved testing apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 3 is a fragmentary sectional view substantially as seen in the direction of arrows from the line III—III of FIG. 2;

FIG. 4 is a fragmentary sectional view similar to that of FIG. 3 but showing certain details of a second testing apparatus.

DESCRIPTION OF THE PREFERRED EMBODIMENTS

Figure 1:
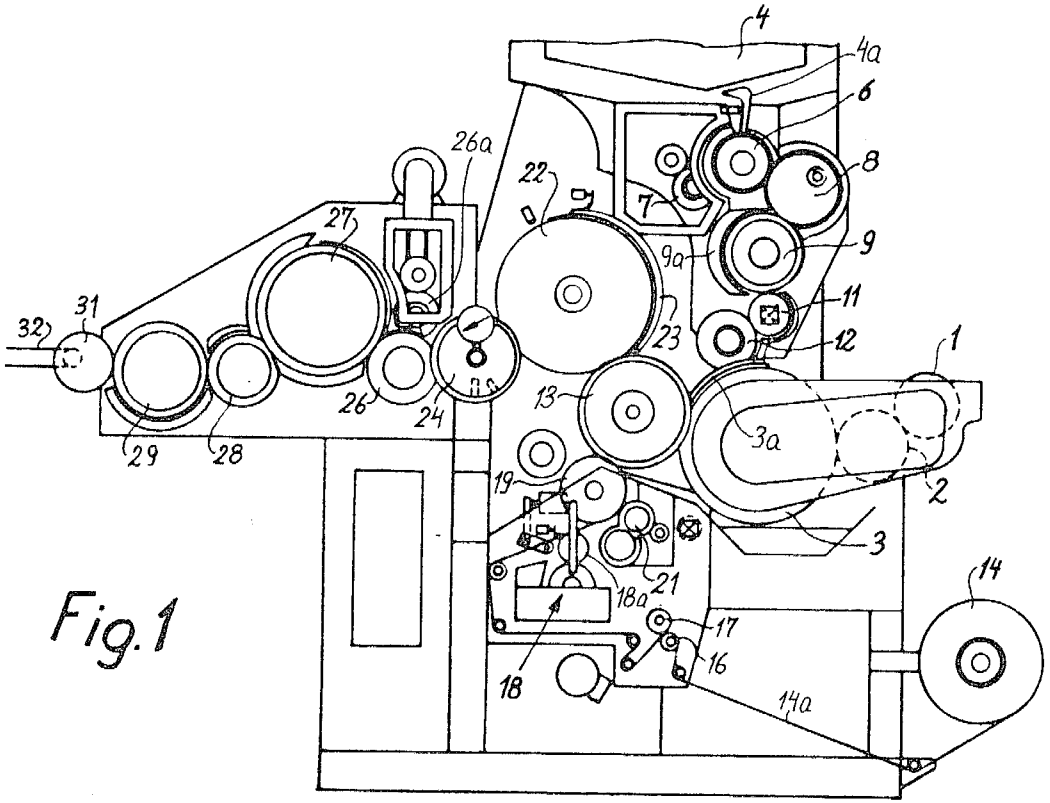
FIG. 1 is a diagrammatic elevational view of a filter cigarette making machine including a testing apparatus which embodies one form of the invention.

Referring first to FIG. 1, there is shown a filter cigarette making machine of the type known as MAX and produced by Hauni-Werke, Körber & Co. K.G., of Hamburg-Bergedorf, Western Germany. The machine comprises a drum-shaped conveyor 1 which has axially parallel peripheral flutes receiving plain cigarettes of unit length from the discharge end of a cigarette rod making machine, not shown. The cigarettes in the flutes of the conveyor 1 form two rows and the cigarettes of one row are staggered with respect to the cigarettes of the other row.

The conveyor 1 delivers the two rows of plain cigarettes to a pair of aligning conveyors 2 which rotate at different speeds or transport the respective cigarettes through different distances so that, at the time the conveyors 2 deliver cigarettes into successive flutes of a drum-shaped assembly conveyor 3, each flute of the conveyor 3 receives a pair of coaxial plain cigarettes which are spaced apart by distances at least slightly exceeding the length of a filter rod section of double unit length.

The machine of FIG. 1 further comprises a magazine or hopper 4 for a supply of parallel filter rod sections of six times unit length. The filter rod sections leave the magazine 4 by moving sideways through a chute **4*a* so as to enter successive flutes of a drum-shaped severing conveyor 6 cooperating with two disk-shaped rotary knives 7 (only one shown in FIG. 1) to subdivide each filter rod section of six times unit length into three coaxial filter rod sections (hereinafter called filter plugs) of double unit length. The filter plugs are taken over by three discrete staggering conveyors 8 which rotate at different speeds or transport the respective filter plugs through different distances so that the filter plugs form a single row of rod-shaped articles which are staggered axially with respect to each other. Successive filter plugs are taken over by a fluted shuffling conveyor 9 which cooperates with two stationary cams 9*a* (one shown) serving to convert the single row of axially staggered filter plugs into an orderly row wherein the filter plugs travel sideways and are in accurate alignment with (i.e., behind) each other. The thus treated single row of filter plugs is taken over by a transfer conveyor 11 which delivers them into successive flutes of an accelerating conveyor 12. The latter inserts successive filter plugs into the gaps between successive pairs of coaxial plain cigarettes in the flutes of the assembly conveyor 3 so that each flute of the conveyor 3 contains a group of three coaxial rod-shaped articles including a centrally located filter plug and two plain cigarettes which flank the respective filter plug. The assembly conveyor 3 transports such groups past two condensing cam 3a** (one shown) which cause the plain cigarettes to move toward each other so as to insure that the inner ends of the plain cigarettes come into actual abutment with the adjacent ends of the respective filter plug.

The machine of FIG. 1 further comprises a supply 14 of paper web, reconstituted tobacco, cork or other suitable wrapping material 14a which is being withdrawn by two advancing rolls 16, 17 and is caused to travel along a roller-shaped applicator 18a forming part of a paster 18. The applicator 18a coats one side of the web 14a with a layer of adhesive paste and the leading end of the thus coated web 14a is attracted to the periphery of a suction drum 19 cooperating with a rotary knife 21 to sever the web 14a at regular intervals so that the web yields a succession of adhesive-coated uniting bands.

The assembly conveyor 3 delivers groups of three rod-shaped articles each into successive flutes of a transfer conveyor 13 which transports the groups past the drum 19 whereby each group receives an adhesive-coated uniting band which adheres to the respective filter plug as well as to the adjoining inner end portions of the respective plain cigarettes. The transfer conveyor 13 delivers the groups (each of which carries a uniting band) to a wrapping conveyor 22 which cooperates with a rolling element 23 to convolute the uniting bands around the respective groups (i.e., around the respective filter plugs and the adjacent inner end portions of the respective plain cigarettes) so that each such group constitutes a filter cigarette of double unit length.

The cigarettes of double unit length are transferred onto a conveyor 24 forming part of the improved testing apparatus and serving to transport successive cigarettes past a testing station where the fillers and/or wrappers of the cigarettes are tested by means of a testing fluid (e.g., air). The testing apparatus produces signals in response to detection of defective filter cigarettes of double unit length and such signals are used to segregate defective cigarettes from satisfactory cigarettes, preferably by resorting to a pneumatic ejector operating in a manner well known from the art of testing rod-shaped smokers' products.

The conveyor 24 of the testing apparatus delivers satisfactory filter cigarettes of double unit length to a severing conveyor 26 which coooerates with a rotary disk-shaped knife 26a to sever each cigarette midway between its end (i.e., across the tubular wrapper which is obtained by convoluting the respective adhesive-coated uniting band) so that each such article yields a pair of filter cigarettes of unit length. The pairs of filter cigarettes of unit length are transferred onto an inverting conveyor 27 which inverts one filter cigarette of each pair end-for-end and places it between successive non-inverted filter cigarettes so that the filter cigarettes leaving the inverting conveyor 27 form a single row wherein the cigarettes move sideways toward a second testing apparatus including a conveyor 29 wherein successive filter cigarettes of unit length are tested for the density of their tobacco fillers at the free ends of such fillers. The cigarettes with defective tobacco filler ends are segregated from satisfactory cigarettes and the satisfactory cigarettes are accepted by a transfer conveyor 31 which delivers them onto the upper stretch of an endless conveyor belt or chain 32 serving to transport satisfactory filter cigarettes of unit length into a tray filling apparatus, directly into a packing machine or to storage. The reference character 28 denotes a transfer conveyor which delivers filter cigarettes of unit length from the inverting conveyor 27 to the conveyor 29 of the second testing apparatus.

Figure 2:
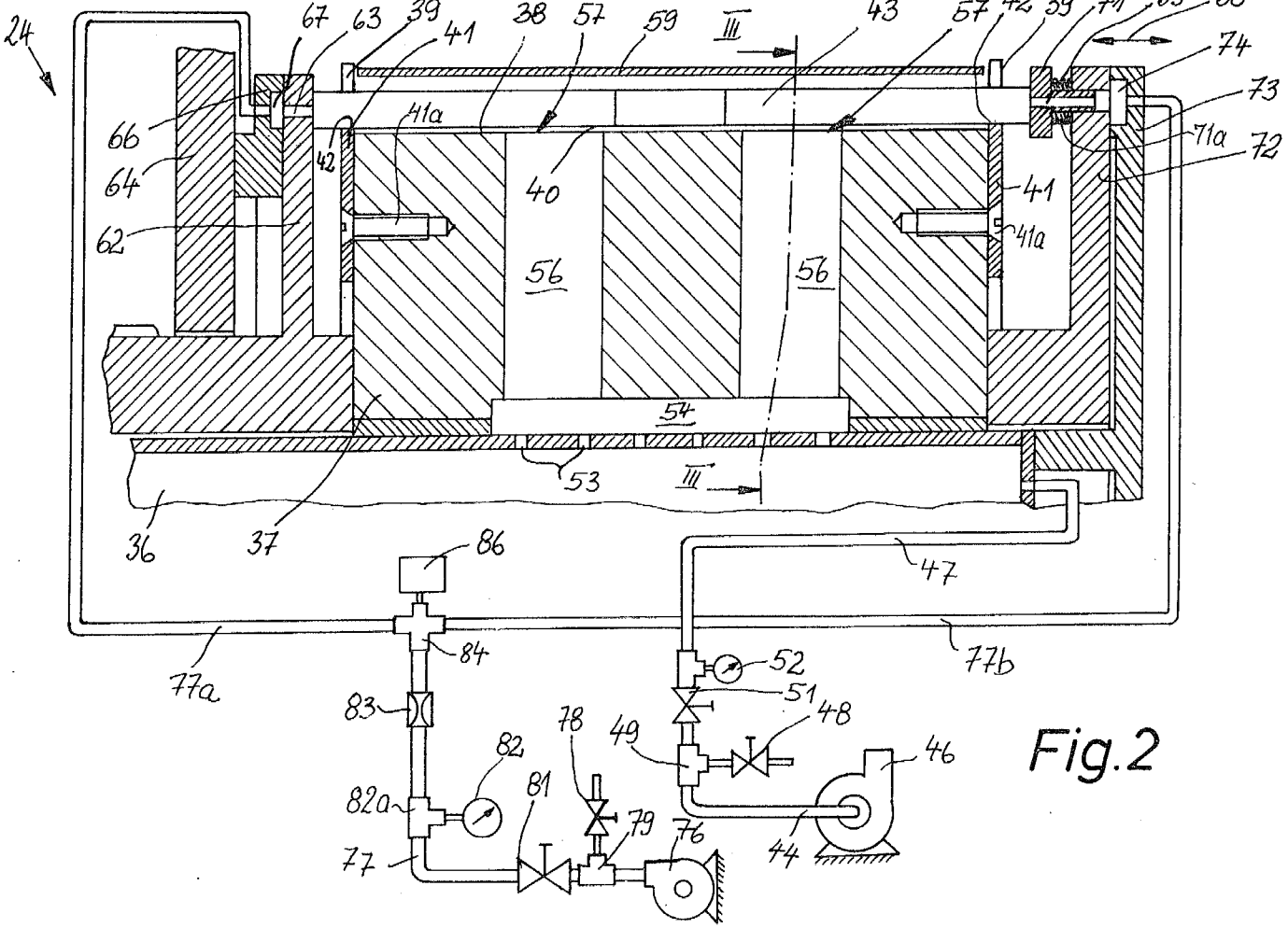
FIG. 2 is an enlarged fragmentary axial sectional view of the conveyor of the testing apparatus and further showing the details of means for conveying through cigarettes a gaseous testing fluid and for monitoring the characteristics of testing fluid.

The details of the testing apparatus including the conveyor 24 are illustrated in FIGS. 2 and 3. The conveyor 24 comprises a cylindrical body 37 which is driven by a system of gears (not shown) receiving torque from the main prime mover of the filter cigarette making machine of FIG. 1 and rotates about the axis of a stationary hollow shaft 36. The cylindrical body 37 has a smooth cylindrical peripheral surface 38.

The end faces of the body 37 are connected with and carry groups of article-supporting elements in the form of cradles 41 extending radially beyond the peripheral surface 38 and being provided at their outer ends with sockets 39 bounded by concave article-engaging surfaces 42. The cradles 41 of each group can form a disk which is secured to the respective end face of the cylindrical body 37 by screws 41a or analogous fasteners. The socket 39 of each cradle 41 at one axial end of the body 37 registers with the socket 39 of a cradle 41 at the other axial end of the body 37. A rod-shaped article 43 (constituting a filter cigarette of double unit length) which is supported by the respective pair of cradles 41 extends in parallelism with the axis of the shaft 36. The depth of the sockets 39 is selected in such a way that an article 43 resting in a pair of aligned cradles 41 is spaced apart from the peripheral surface 38 of the cylindrical body 37, i.e., there remains a clearance or gap 40 shown in the upper portion of each of FIGS. 2 and 3.

In accordance with a feature of the invention, the distance between a pair of aligned cradles 41 is slightly less than the length of an article 43 so that the ends of a properly inserted and supported article extend beyond the respective sockets 39. Also, the area of those portions of the surfaces 42 which come into contact with the wrapper of a properly inserted and supported article 43 is preferably less than the area of the end face of an article 43. This insures that by far the major portion of the external surface of the wrapper of the article 43 is exposed (i.e., it is not contacted by any solid parts so that such major portion of the wrapper can be properly tested for the presence or absence of leaks in the form of open seams, tears, holes and/or other defects. As shown in FIGS. 2 and 3, the entire wrapper of an article 43 is contacted only by a relatively small portion of the respective surface 42 at one axial end of the body 37 and by a small portion of the respective surface 42 at the other axial end of the body 37.

The testing apparatus of FIGS. 2 and 3 further comprises a suction generating device in the form of a fan 46 having a suction inlet 44 connected with a conduit 47 which communicates with the interior of the hollow shaft 36. The shaft 36 has a number of orifices 53 which communicate with an annular compartment 54 provided in the cylindrical internal surface of the cylindrical body 37. The latter is further provided with pairs of suction openings in the form of slots 56, one pair for each pair of aligned cradles 41. The inner end portions of the openings or slots 56 communicate with the compartment 54 (and hence with the suction inlet 44 of the fan 46) and the outer end portions 57 of the slots 56 communicate with the space between the respective pair of aligned cradles 41 so that the air streams rushing into the slots 56 when the fan 46 is on attract the articles 43 and prevent them from leaving the respective sockets 39 under the action of gravity and/or centrifugal force while the conveyor 24 rotates to transport the articles 43 from the wrapping conveyor 22 toward the severing conveyor 26 of the filter cigarette making machine shown in FIG. 1.

The conduit 47 contains a tee 49 which is connected with a first pressure regulating valve 48 located downstream of a second pressure regulating valve 51 and a pressure gauge 52. By looking at the dial of the gauge 52, an operator can manipulate the valves 48 and 51 in such a way that the air pressure in the slots 56 of the cylindrical body 37 is maintained within a predetermined range which is best suited to insure satisfactory retention of articles 43 in the respective pairs of cradles 41 as well as to insure a satisfactory pneumatic testing of articles, and more particularly of the wrappers of such articles.

As shown in FIG. 3, the outer end portions 57 of the slots 56 are aligned with (i.e., located between) the respective pairs of cradles 41 so that the air streams flowing into the end portions 57 can prevent the articles 43 from leaving the respective sockets 39 even if the pressure in the slots 56 is not much lower than atmospheric pressure. Furthermore, suction in the slots 56 is not sufficient to cause the articles 43 to flex and to thereby reduce the width of the respective gaps 40 to zero. In other words, the gaps 40 remain intact irrespective of whether the slots 56 communicate with or are sealed from the suction inlet 44 of the fan 46.

The upper part of the rotating cylindrical body 37 is overlapped by an arcuate cover or shroud 59 which is pivotally connected to the frame of the filter cigarette making machine by a hinge 61 so that it can be lifted above and away from the peripheral surface 38 of the cylindrical body 37. The cover 59 prevents particles of tobacco and tobacco dust from descending into the area surrounding the peripheral surface 38. Such particles (which are likely to become separated from tobacco fillers during rolling of groups on the wrapping conveyor 22) could interfere with operation of the testing apparatus, for example, by entering the slots 56 of the body 37 and/or by entering the ports 63 and/or 64 which are provided in the apparatus to admit a pressurized testing fluid into the interior of each article 43 which travels past a testing station located between the conveyors 22 and 26 of FIG. 1.

The means for admitting testing fluid into the wrappers of successive articles 43 comprises a disk-shaped flange 62 which is rigid with the body 37 and is provided with the aforementioned ports 63, one for each cradle 41 at the respective axial end of the conveyor 24. The outer side of the flange 62 slides along a stationary valve plate 66 which is provided with an arcuate groove 67. The valve plate 66 is secured to a frame member 64 of the filter cigarette making machine. When the body 37 rotates with the flange 62, successive ports 63 communicate with the groove 67 of the valve plate 66. The groove 67 is connected with the high-pressure outlet of a second fan 76 by a conduit **77*a* and a further conduit 77. The conduit 77 contains a tee 79 (which is connected with a first pressure regulating valve 78), a second pressure regulating valve 81, a tee 82*a* which is connected with a pressure gauge 82, and an adjustable flow restrictor 83. A junction 84 connects the conduit 77 with the conduit 77*a* as well as with a further conduit 77*b* which delivers pressurized testing fluid (preferably air) to the arcuate groove 74 of a second stationary valve plate 73 secured to the hollow shaft 36. The valve plate 73 is adjacent to a second flange 72 which rotates with the cylindrical body 37 and serves as a carrier or holder for a set of axially movable coupling elements in the form of tubes 71 provided with the aforementioned axial passages or ports 69. The tubes 71 are movable axially (as indicated by a double-headed arrow 68) to thereby move toward or away from the registering ports 63 in the flange 62. Each tube 71 is biased toward the adjacent socket 39 by a weak helical spring 71*a*. The means for moving the tubes 71 in a direction to the left, as viewed in FIG. 2, during travel of the respective cradles 41 past the testing station preferably comprises a stationary cam (not shown) and followers provided on the tubes 71 and tracking a cam face (or extending into a cam groove) of the cam. Such means for moving tubes axially are customary in the art of testing smokers' products by resorting to apparatus wherein the products travel sideways past a testing station. Successive passages or ports 69 communicate with the groove 74 of the valve plate 73 while the cylindrical body 37 rotates to move a succession of articles 43 sideways from the transfer station between the conveyors 22, 24 toward the transfer station between the conveyors 24, 26**.

The testing apparatus further comprises a transducer 86 which is connected with the junction 84 and serves as a means for comparing the pressure of testing fluid in the conduits **77*a*, 77*b* with a predetermined range of pressures which are indicative of articles 43 with satisfactory wrappers. When the pressure of testing fluid in the conduits 77*a*, 77*b* is outside of such range, this indicates the presence of an article with a defective wrapper. Such article is segregated from satisfactory articles in a conventional manner, preferably by the aforementioned pneumatic ejector (not shown) which receives signals from the transducer 86. The latter may comprise a diaphragm which is flexed by testing fluid whereby the extent of flexure indicates the pressure of testing fluid. The diaphragm may form part of a capacitor or an inductance which produces signals indicating the condition of the tested articles. The aforementioned pneumatic ejector may comprise one or more nozzles which are connected with a source of pressurized fluid (e.g., air) in response to those signals from the transducer 86 which are indicative of defective wrappers. The orifice of the ejector nozzle is adjacent to the path of articles 43 downstream of the testing station (i.e., adjacent to the path of articles 43 on the conveyor 24 or on a conveyor which follows the conveyor 24) and the signals furnished by the transducer 86 are delayed so that the nozzle discharges a jet or pressurized fluid at the exact moment when it registers with an article 43** whose wrapper has been found to be defective.

The operation of the testing apparatus of FIGS. 2 and 3 is as follows.

The person in charge adjusts the valves 48, 51 and 78, 81 by simultaneously observing the dials of the associated pressure gauges 52, 82 in such a way that the pressure in the conduit 47 (gauge 52) and conduits **77*a*, 77*b* (gauge 82) corresponds to an optimum pressure for testing. The valves 48 and 51 are adjusted to determine the amounts of air which flow into the slots 56 per unit of time; such amounts are selected with a view to insure that the inflowing air streams prevent the articles 43 from leaving the respective pairs of sockets 39 under the action of gravity and/or centrifugal force when the conveyor 24 is driven to transport the articles 43 from the conveyor 22 toward the conveyor 26. The fan 46 is assumed to be driven by a motor (not shown) so that it draws streams of air through the outer end portions 57 of the slots 56 travelling from the conveyor 22 toward the conveyor 26 whereby the inflowing streams of air can serve as a means for attracting articles 43 which are being delivered by the conveyor 22. The air streams which enter by way of the end portions 57 flow through the respective slots 56, compartment 54, orifices 53, the interior of the shaft 36, conduit 47, suction inlet 44 and into the fan 46. Such air streams are capable of attracting the articles 43 which are being supplied by the conveyor 22 so that the transfer station between the conveyors 22 and 24 need not be provided with any complex transfer means for insuring that successive articles 43 will invariably enter successive pairs of aligned sockets 39 on the cylindrical body 37 of the conveyor 24. It has been found that the transfer of articles 43 into the cradles 41 is quite satisfactory even if the sockets 39 are not machined with a high degree of precision, even if the cradles 41 at one end of the body 37 are not in exact alignment with cradles 41 at the other axial end of the body 37, and even if successive flutes of the wrapping conveyor 22 do not register exactly with successive pairs of cradles 41. It is preferred to use a fan 46 which can circulate large quantities of air per unit of time at a relatively low subatmospheric pressure which is sufficient to insure that the articles 43 cannot be expelled from their sockets 39 under the action of centrifugal force even if the conveyor 24 is driven at a high speed. The cover 59 prevents particles of tobacco or other solid particulate material from entering the slots 56. Such particles are likely to become liberated at the ends of plain cigarettes during rolling on the wrapping conveyor 22 and would be likely to interfere with operation of the testing apparatus by clogging the orifices 53, conduit 47, valve 48 and/or 51 and/or the fan 46**. Moreover, such particles could cause excessive wear upon the sealing elements in the conduitry for suction air.

As an article 43 in a pair of aligned cradles 41 moves beyond the transfer station between the conveyors 22 and 24, the aforementioned cam allows the spring 71*a* for the respective tube 71 to move the tube axially toward the aligned port 63 in the flange 62. The front end face of the tube 71 engages the adjacent end face of the article 43 and moves the other end face of the article into abutment with the flange 62. The end faces of the article 43 are then properly sealed by the tube 71 and flange 62 and, at the same time, the respective ports 63, 69 begin to communicate with the grooves 67, 74 of the valve plates 66, 73. Thus, the fan 76 admits pressurized fluid to both ends of the wrapper of an article 43 by way of the conduits 77*a*, 77*b*, grooves 67, 74 and the respective ports 63, 69. If the wrapper which travels past the testing station has a leak, the pressurized fluid escapes so that the pressure in the conduits 77*a*, 77*b* drops. Such pressure is monitored by the transducer 86 which transmits to the ejector a signal whenever the pressure of testing fluid is without a range which is indicative of satisfactory wrappers. The ejector thereupon segregates the article 43 with a defective wrapper from the articles with satisfactory wrappers.

The width of each cradle 41, as considered in the axial direction of the cylindrical body 37, is only a minute fraction of the distance between two aligned cradles. This feature, combined with the feature that the wrappers of the articles 43 do not contact the peripheral surface 38 of the body 37, insures that practically the entire external surface of a wrapper is exposed during travel past the testing station, i.e., that each and every leak in the wrapper will be detected save for the minute leak or leaks which might be sealed by the surfaces 42 of the respective cradles 41. Since the width of each cradle 41 is minimal, the area of that portion of each surface 42 which contacts a wrapper can be selected with a view to insure that such area is smaller (and preferably much smaller) than the area of the end face of an article 43.

Another advantage of cradles 41 which engage the articles 43 only in the regions adjacent to the ends of the wrappers is that an undetected leak in that portion of a wrapper forming part of a filter cigarette which is adjacent to the tobacco-containing end of the cigarette is much less irritating to the smoker than a leak in the proximity of the junction between the tobacco-containing section and the filter plug. This will be readily appreciated since the cigarette burns in a direction toward the filter plug and, therefore, a minor leak which might pass undetected and is located close to the tobacco-containing end of the cigarette allows some air to enter the cigarette only as long as the corresponding part of the wrapper remains intact, i.e., while the smoker draws one, two or even three columns of smoke. On the other hand, an undetected hole close to the filter plug allows air to enter the wrapper until the very end, i.e., until the entire tobacco containing section is consumed. By placing the cradles 41 close to the ends of the tested articles, we insure that any leaks, if they remain undetected, appear only in the region of the tobacco-containing ends of the filter cigarettes of unit length which are obtained by severing the articles 43 midway across their filter plugs of double unit length.

An advantage of a cylindrical conveyor body 37 with a smooth peripheral surface is that it can be manufactured at a low cost.

FIG. 4 illustrates a portion of a modified testing apparatus wherein the conveyor (corresponding to the conveyor 24 of FIGS. 2 and 3) comprises a cylindrical body 187 provided with radial openings 156 in the form of slots whose inner ends communicate with an annular compartment 154 which, in turn, communicates with the interior of the hollow stationary shaft 136 by way of orifices 153. The peripheral surface of the cylindrical body 187 is provided with axially parallel flutes 188 bounded by concave surfaces 189 which remain spaced apart from the wrappers of rod-shaped articles 143 while the end portions of the articles engage the surfaces 142 bounding the sockets 139 in the respective supporting elements or cradles 141. The gaps or clearances between the wrappers of the articles 143 and the surfaces 189 bounding the flutes 188 are indicated at 191. Such gaps communicate with the outer end portions 192 of the respective slots 156. An advantage of the flutes 188 is that the streams of air which flow into the end portions 192 of the slots 156 can produce a more pronounced retaining action which prevents ejection of articles 143 from the respective pairs of cradles 141 under the influence of gravity and/or centrifugal force, even when the conveyor including the cylindrical body 187 is driven at a high speed. The reference character 159 denotes a cover or shroud which overlies the cradles 141 travelling past the testing station and is pivotally secured to the frame of the filter cigarette making machine by a hinge 161.

Figure 5:
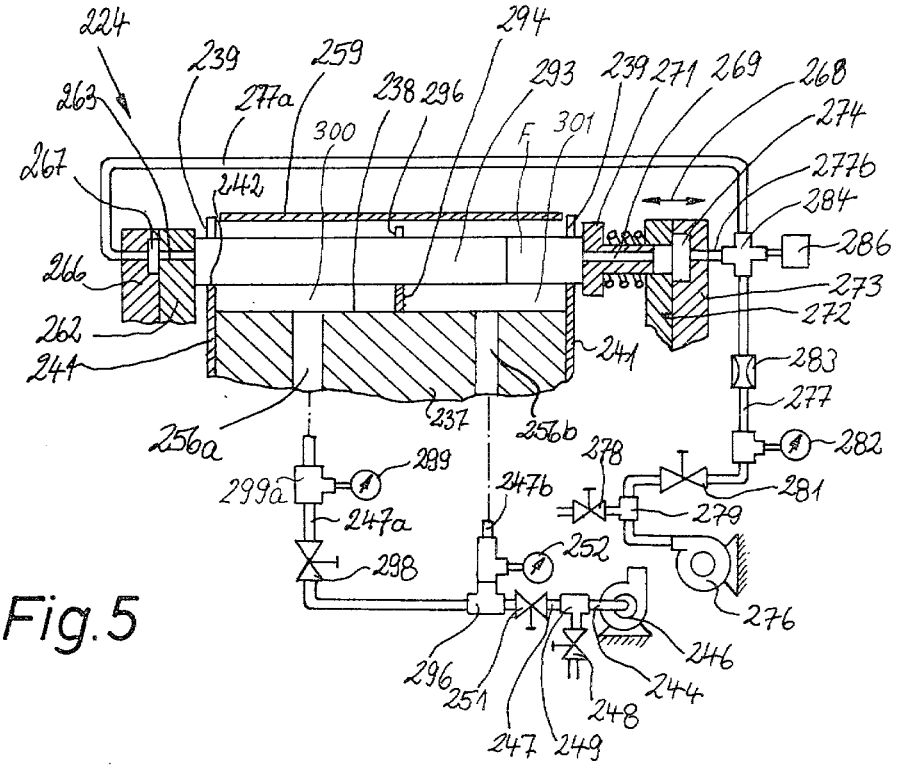
FIG. 5 is a view similar to that of FIG. 2 but showing a third testing apparatus.

Referring to FIG. 5, there is shown a third testing apparatus wherein all such parts which are identical with or clearly analogous to the corresponding parts of the testing apparatus of FIGS. 2 and 3 are denoted by similar reference characters plus 200. The articles 293 to be tested are filter cigarettes of unit length. The conveyor 224 of the testing apparatus comprises a cylindrical body 237 which is rotatable on a stationary hollow shaft (not shown). The conveyor 224 can occupy in a filter cigarette making machine a position corresponding to that of the conveyor 28 or 29 shown in FIG. 1, i.e., downstream of the inverting conveyor. The end faces of the cylindrical body 237 are connected with supporting elements in the form of cradles 241 having sockets 239 for the end portions of wrappers of the respective articles 293. The concave surfaces bounding the sockets 239 are shown at 242. It will be noted that the axial length of the cylindrical body 237 is less than the axial length of an article 293.

The central portion of the cylindrical peripheral surface 238 of the body 237 is surrounded by a sheet metal partition 294 having sockets 296 each of which is in register with the sockets 239 of two aligned cradles 241. The surfaces surrounding the sockets 296 engage portions of wrappers of the articles 293 in the corresponding cradles 241. Furthermore, the partition 294 subdivides the space between the two groups of cradles 241 into a pair of annular chambers 300, 301 which respectively communicate with radial openings or slots 256*a*, 256*b* of the cylindrical body 237. The fan 246 has a suction inlet 244 which is connected with a conduit 247 by way of a tee 249 supporting a pressure regulating valve 248. The conduit 247 contains a second pressure regulating valve 251 and a second tee 296 which is connected with a pressure gauge 252 and with two branch conduits 247*a*, 247*b*. The conduit 247*a* contains a pressure regulating valve 298 and a tee 299*a* for a pressure gauge 299. Each of the slots 256*a* (and hence the chamber 300) communicates with the conduit 247*a*, and each of the slots 256*b* (and hence the chamber 301) communicates with the conduit 247*b* wherein the pressure of fluid can be regulated by the valve 248 and/or 251.

The purpose of the chambers 300, 301 and slots 256*a*, 256*b* is to insure that each end portion of an article 293 can be held with a requisite force against the influence of gravity and/or centrifugal force when the cylindrical body 237 is driven by the main prime mover of the filter cigarette making machine. Those ends of the filter cigarettes of unit length which include the filter plugs F are normally heavier than the other (tobacco-containing) ends. Therefore, the valves 248, 251, 298 are adjusted in such a way that the suction in chamber 301 is more pronounced than in the chamber 300 with the result that the ends of articles 293 including the filter plugs F are attracted with a greater force.

The construction of means for admitting a pressurized testing fluid into the ends of wrappers travelling past the testing station is the same as described in connection with FIG. 2. The transducer 286 furnishes signals which are indicative of articles 293 with defective wrappers whenever the pressure of testing fluid in the conduits 277*a*, 227*b* is below a range of fluid pressures which are indicative of satisfactory wrappers, and such signals are used to segregate the articles with defective wrappers from other articles.

An important advantage of the improved testing apparatus is that only very small portions of the external surfaces of wrappers are in contact with solid parts (surfaces surrounding the sockets 39, 139, 239 and 296) so that the major part of each wrapper can be tested for the presence or absence of leaks to thus insure a more reliable testing. Moreover, and since the air streams which are being sucked into the outer end portions of the slots in the cylindrical body 37, 187 or 237 can flow around a major part of the external surface of each wrapper, such air streams can furnish a highly satisfactory retaining action. Furthermore, the air streams can effect the transfer of articles from the preceding conveyor into the cradles of the conveyor of the testing apparatus even if the flutes or other article receiving means on the preceding conveyor are not in accurate alignment with the cradles during transfer of articles. Still further, and since the pressure in the slots of the cylindrical body need not be reduced well below atmospheric pressure, the testing apparatus can operate with a relatively small, simple, inexpensive and practically or substantially noiseless suction generating device with low energy requirements.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. In an apparatus for testing cigarettes or analogous articles consisting of or having open-ended tubular wrappers, a combination comprising conveyor means arranged to transport successive articles to be tested sideways toward, past and beyond a testing station and including pairs of spaced-apart article supporting elements with each pair of supporting elements engaging spaced-apart portions of the wrapper of an article during travel toward, past and beyond said testing station, said conveyor means further having at least one opening provided intermediate each of said pairs of supporting elements and being spaced apart from the wrappers of articles in the respective supporting elements; and suction generating means communicating with said openings while said openings travel toward, past and beyond said testing station so that the streams of air flowing into said openings attract the wrappers of articles to the respective pairs of supporting elements.

2. A combination as defined in claim 1, wherein said conveyor means includes an endless conveyor and the width of each of said supporting elements is a small fraction of the distance between a pair of supporting elements.

3. A combination as defined in claim 1, wherein each of said supporting elements has an article-contacting surface and the area of each of said surfaces is smaller than the area of the end face of an article.

4. A combination as defined in claim 1, wherein the distance between the supporting elements of each of said pairs is slightly less than the axial length of an article so that said supporting elements contact the articles close to the ends of such articles.

5. A combination as defined in claim 1, wherein said suction generating means comprises a fan.

6. A combination as defined in claim 1, wherein said conveyor means further includes a rotary body having a substantially smooth peripheral surface and said supporting elements are cradles provided at the axial ends of said body, said openings being provided in said peripheral surface of said body.

7. A combination as defined in claim 6, wherein each of said supporting elements has a concave article-contacting surface.

8. A combination as defined in claim 1, wherein said conveyor means further comprises a body having axially parallel peripheral flutes each extending between a pair of said supporting elements and each receiving with clearance a portion of a wrapper which is carried by the respective supporting elements.

9. A combination as defined in claim 8, wherein said supporting elements are cradles provided at the axial ends of said body and said openings communicate with the respective flutes.

10. A combination as defined in claim 1, further comprising means for regulating the rate of air flow into said openings.

11. The combination of claim 1, wherein said article supporting elements have article-contacting surfaces which are free of suction ports.

* * * * *